US005297655A

United States Patent [19]

Wolfe

[11] Patent Number: 5,297,655

[45] Date of Patent: Mar. 29, 1994

[54] COLLAPSIBLE SAWHORSE

[76] Inventor: Danny K. Wolfe, Rte. 3, Box 3820, Bean Station, Tenn. 37708

[21] Appl. No.: 950,283

[22] Filed: Sep. 24, 1992

[51] Int. Cl.[5] ..... B27B 21/00

[52] U.S. Cl. ..... 182/153; 182/186; 182/226

[58] Field of Search ..... 182/153, 154, 181–186, 182/224–227

[56] References Cited

U.S. PATENT DOCUMENTS

| | | | |
|---|---|---|---|
| 25,039 | 8/1859 | Parkhurst | 182/153 |
| 560,669 | 5/1896 | Abel | 108/157 X |
| 1,961,760 | 6/1934 | Hampsen | 187/226 |
| 3,830,340 | 8/1974 | Schaffel | 182/226 |
| 4,502,563 | 3/1985 | Pershon | 182/153 |
| 4,565,263 | 1/1986 | Southworth | 182/184 |
| 4,620,613 | 11/1986 | Albertson | 182/153 |
| 4,681,187 | 7/1987 | Brown | 182/129 |
| 4,703,830 | 11/1987 | Parker | 182/151 |
| 4,730,698 | 3/1988 | Harris | 182/225 |
| 4,967,877 | 11/1990 | Wallman et al. | 182/155 |
| 5,012,893 | 5/1991 | Kraeger | 182/153 |

FOREIGN PATENT DOCUMENTS

| | | | |
|---|---|---|---|
| 873877 | 7/1942 | France | 182/226 |
| 1101128 | 9/1955 | France . | |
| 173257 | 11/1960 | Sweden . | |
| 400787 | 11/1933 | United Kingdom | 182/186 |

*Primary Examiner*—Alvin C. Chin-Shue
*Attorney, Agent, or Firm*—Pitts & Brittian

[57] ABSTRACT

A collapsible sawhorse unit that, when unfolded and combined with a replaceable crosspiece, produces a sturdy and economical sawhorse. The unit includes the two A-shaped end pieces, of two legs each, that fold toward each other with the legs of each end piece folding toward each other. A folding upper longitudinal brace joins upper ends of the end pieces, and a pair of lower folding longitudinal braces joins the end pieces proximate a mid-point. Folding transverse braces of each end piece provide rigid separation of legs during use such that upper ends of the legs clamp against the replaceable crosspiece. Components of the folding unit are typically fabricated from standard metal stock. The resultant folding unit occupies a minimum volume, when folded, for convenient transport to a construction site.

11 Claims, 4 Drawing Sheets

FIG. 4
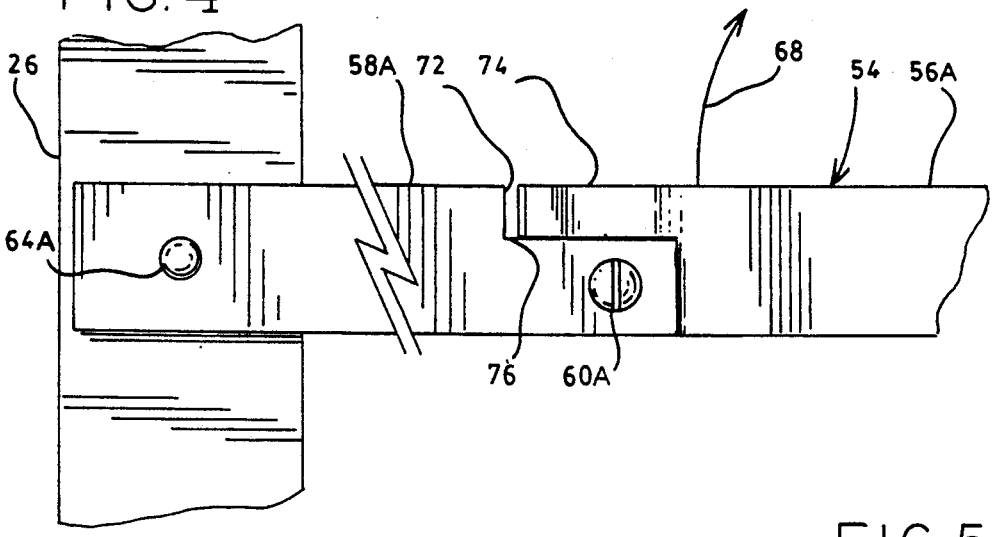
FIG. 5
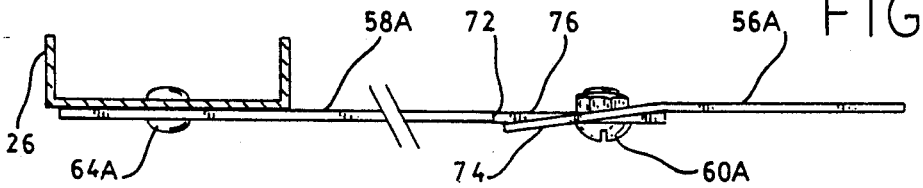
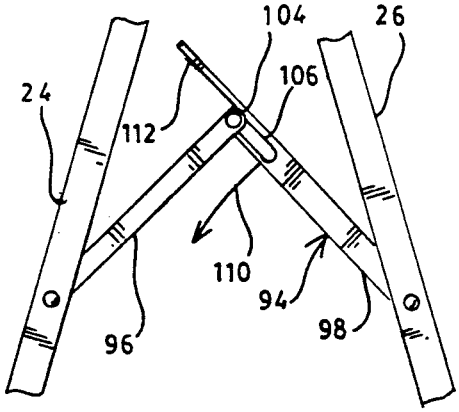
FIG. 10
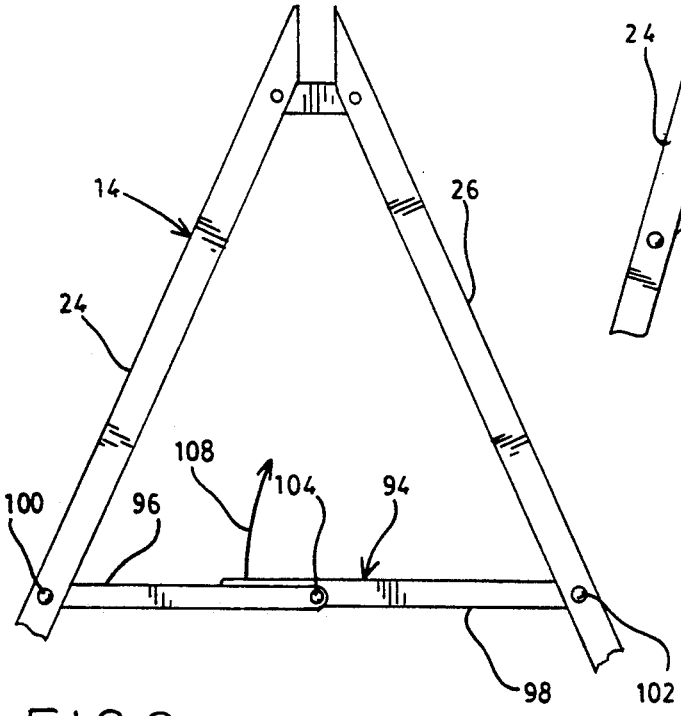
FIG. 9

COLLAPSIBLE SAWHORSE

DESCRIPTION

1. Technical Field

This invention relates to support devices for use during the fabrication of objects, and more particularly to a sawhorse that can be folded into a compact unit for ease of transport by contractors and the like.

2. Background Art

A common device used by carpenters, as well as by other types of contractors, is a saw horse used to support objects for sawing, drilling and like operations where it is desirable to have the object in a raised position to facilitate these operations. Typically, the sawhorse has a pair of A-shaped end supports that are joined by a crosspiece upon which the object is supported. Usually a pair of saw horses are utilized, one to support each end of the object being subjected to some type of operation. Most conventionally, the A-shaped end supports and the crosspiece are permanently joined for rigidity when in use. This makes them bulky and thus more difficult to transport to a work site.

In order to overcome this matter of bulk, several alternate constructions have been utilized. One of the simplest of these sawhorse constructions has been a pair of metal (or plastic) socket-type devices that accept short pieces of wood or metal for legs and which, when assembled, form the end support members of the sawhorse. These units then releasably engage a crosspiece to complete the sawhorse unit. The legs and crosspiece are typically fabricated from scraps available at the work site. Although providing ease of portability, these units have limited stability to movement during use.

Other sawhorse units have been developed to address both portability and rigidity. Typical of these devices are shown in U.S. Pat. Nos. 4,502,563 issued to J. Pershon on Mar. 5, 1985; U.S. Pat. No. 4,565,263 issued to T. Southworth on Jan. 21, 1986; U.S. Pat. No. 4,620,613 issued to C. Albertson on Nov. 4, 1986; U.S. Pat. No. 4,681,187 issued to D. Brown on Jul. 21, 1987; U.S. Pat. No. 4,967,877 issued to R. Wallman, et al, on Nov. 6, 1990; and U.S. Pat. No. 5,012,893 issued to T. Kraeger on May 7, 1991. Other patents relative to the present invention are U.S. Pat. No. 4,703,830 issued to J. Parker on Nov. 3, 1987; Swedish Patent No. 173,257 published on Nov. 8, 1960; and French Patent No. 1,101,128 published on Sep. 28, 1955.

While each of the above-cited patents identifies specific collapsible features, there is still significant bulk that reduces portability to a job site. In addition, several of the devices utilize specialized components that increase construction costs. Several of the units would either be damaged by a saw (such as a rotary saw), or would severely damage a saw, if a saw engages the crosspiece.

Accordingly, it is an object of the present invention to provide a completely collapsible sawhorse that occupies a minimum amount of volume such that portability to a job site is maximized.

Another object of the present invention is to provide a sawhorse of extreme portability that utilizes, in part, material obtainable on a job site.

A further object of the present invention is to provide a collapsible sawhorse that utilizes an easily replaced crosspiece, the crosspiece offering no damage to a saw blade.

It is also an object of the present invention to provide a collapsible saw horse construction that utilized standard materials such that cost of fabrication is reduced.

These and other objects of the present invention will become apparent upon a consideration of the drawings referenced below, together with a complete description thereof that follows.

DISCLOSURE OF THE INVENTION

In accordance with the present invention, there is provided a collapsible sawhorse unit that includes all components necessary for one end of a sturdy and portable sawhorse. A pair of A-shaped end supports are each formed from a pair of legs that are pivotally connected near one end and have a transverse folding brace joining each toward a further end. This folding brace collapses during transport but provides stable separation of the legs during use. Additional bracing is provided by a first folding longitudinal element pivotally joined to each A-shaped end support legs near their pivoted end, and a pair of additional folding longitudinal elements pivotally joined to respective legs proximate the point of attachment of the aforementioned brace to establish leg separation of each A-shaped end support. Typically the legs and transverse brace are fabricated from aluminum channel stock such as used in side rails of ladders, and the longitudinal braces are fabricated of flat aluminum stock of standard sizes. An replaceable on-site supplied crosspiece is clamped between the tops of the leg elements as they are spread to form the A-shaped end supports. With the crosspiece removed, the legs and braces fold into a compact unit for easy transport.

BRIEF DESCRIPTION OF THE DRAWINGS

FIG. 4 is an elevational view, partially cut away, of the longitudinal brace of the structure illustrated in FIG. 1.

FIG. 5 is a top view, partially cut away, of the longitudinal brace of FIG. 4.

FIG. 9 is a drawing of an end view of a sawhorse according to the present invention in which an alternate form of transverse brace is illustrated.

FIG. 10 is a drawing, partially cut away, of the transverse brace shown in FIG. 9.

BEST MODE FOR CARRYING OUT THE INVENTION

Figure 1:
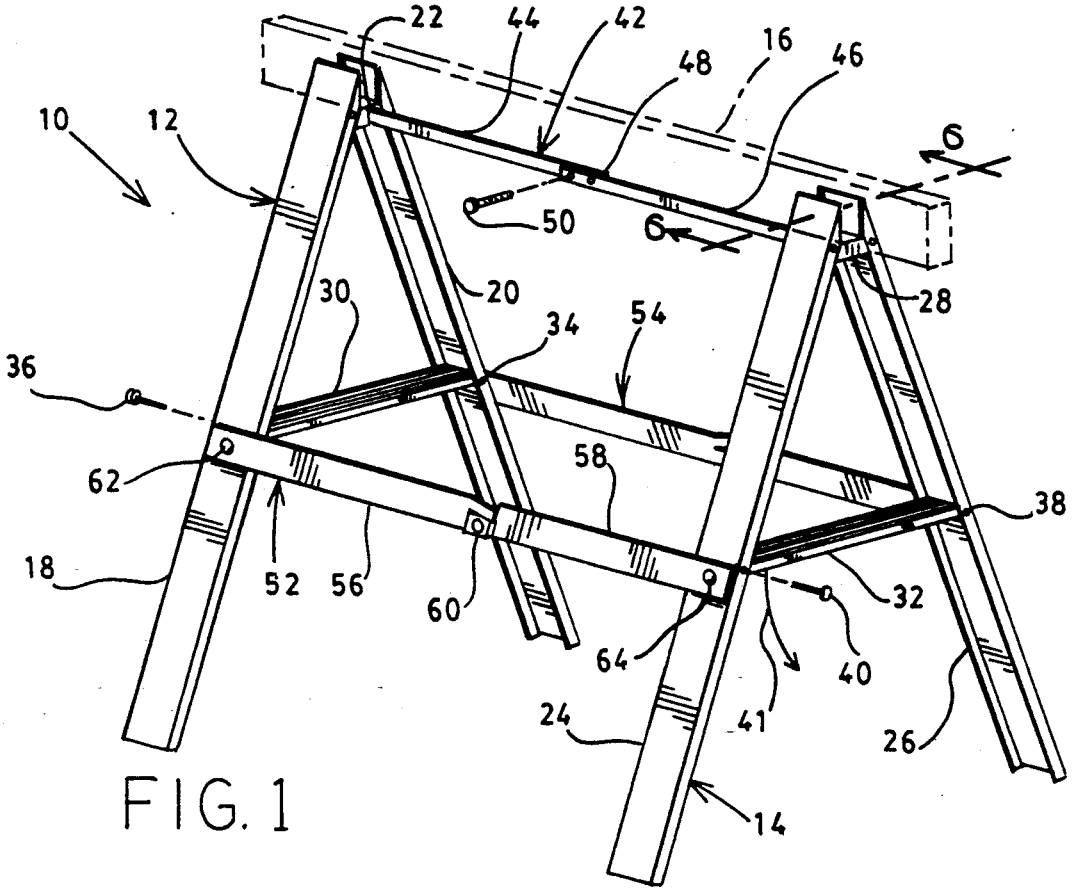
FIG. 1 is a perspective view of a collapsible sawhorse unit according to the present invention when the components thereof are extended to receive a replaceable crosspiece.

A sawhorse unit according to the present invention is shown at 10 in the perspective drawing of FIG. 1. A pair of A-shaped end supports 12, 14 are separated when the unit is in use by a piece of wood or other sacrificial material 16 that typically is available on a construction site. End support 12 is fabricated from legs 18, 20 that are pivotally joined using a bracket 22 (as more clearly seen in FIG. 6). In a similar manner, end support 14 is formed from legs 24, 26 pivotally joined using a bracket 28 that is like bracket 22. Legs 18, 20, 24, and 26, as well as brackets 22 and 28, are typically fabricated from aluminum channel stock of standard sizes. For example, the legs are typically $\frac{1}{8}\times1\times3$ inches (3 mm×2.5 cm×7.5 cm). The brackets are typically $\frac{1}{8}\times\frac{3}{4}\times2\frac{3}{4}$ inches (3 mm×2 cm×6.5 cm).

Each of the end supports 12, 14 is provided with a transverse brace 30, 32, respectively. In the embodiment shown, transverse brace 30 is pivotally joined to leg 20 with a pivot member 34, with the opposite end being releasably engaged with leg 18 with a removable pin or bolt 36. This brace 30 has a Width such as to be received within the channel of leg 20 during folding of the sawhorse. A similar construction is utilized for transverse brace 32 where it is pivotally joined to leg 26 with a pivot member 38 and releasably joined to leg 24 with a removable pin or bolt 40. The transverse braces 30 and 32 are typically fabricated from aluminum channel stock of standard size, typically the same as brackets 22 and 28. As indicated by the arrow 41, the brace 30 can be pivoted downwardly when the pin 40 is removed. Brace 30 can be similarly pivoted downwardly upon removal of pin 36.

The sawhorse unit 10 is provided with folding longitudinal braces to establish a selected spacing between the end supports 12 and 14. There is a first longitudinal brace 42 formed from two portions 44, 46 pivotally joined as at pivot point 48. These portions can be rigidly joined during use of the saw horse by use of a pin or bolt 50. As discussed with regard to FIG. 6, opposite ends of the longitudinal brace 42 are pivotally joined to the brackets 22 and 28. Brace 42 is typically fabricated from stock $\frac{1}{4}\times\frac{3}{4}$ inches (5 mm×2 cm).

Two other longitudinal braces 52, 54 are provided to join end supports 12, 14, one on each side of the sawhorse 10. Brace 52 is formed with two portions 56, 58 that are pivotally joined at 60, with the confronting ends having a locking structure that is more clearly shown in FIGS. 4 and 5. Opposite ends of brace 52 are pivotally joined to legs 18 and 24 with pivot members 62 and 64, respectively. The brace 54 is similarly formed and similarly pivotally joined to legs 20 and 26. These braces 54, 56 are typically fabricated from stock $\frac{1}{4}\times2$ inches (5 mm×5 cm).

Figure 2:
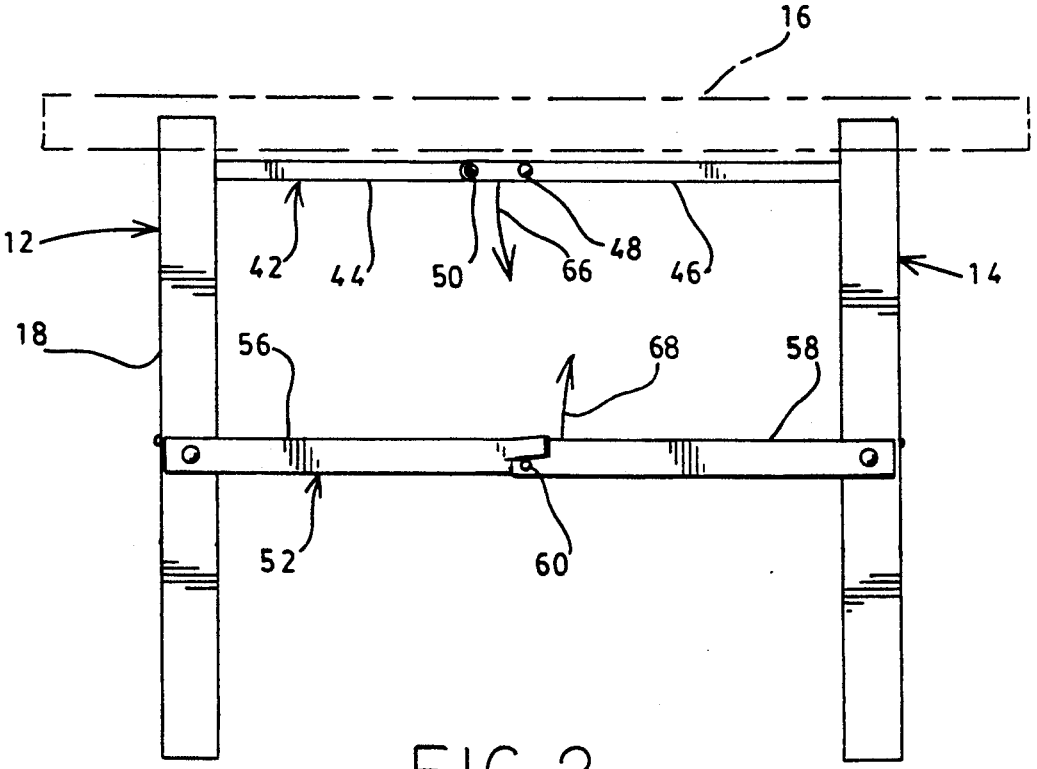
FIG. 2 is a side view of the structure illustrated in FIG. 1.

A front view of the sawhorse 10 is shown in FIG. 2. It can be seen that when pin 50 is removed from the longitudinal brace 42, the portions thereof can be pivoted downwardly as indicated by the arrow 66 (when the crosspiece 16 is removed). At the same time the longitudinal brace 52 (and brace 54) can be pivoted at the pivot 60 in an upward direction indicated by the arrow 68. The ultimate pivoting of these braces permits the end supports 12, and 14 to be brought together (see FIG. 8).

Figure 3:
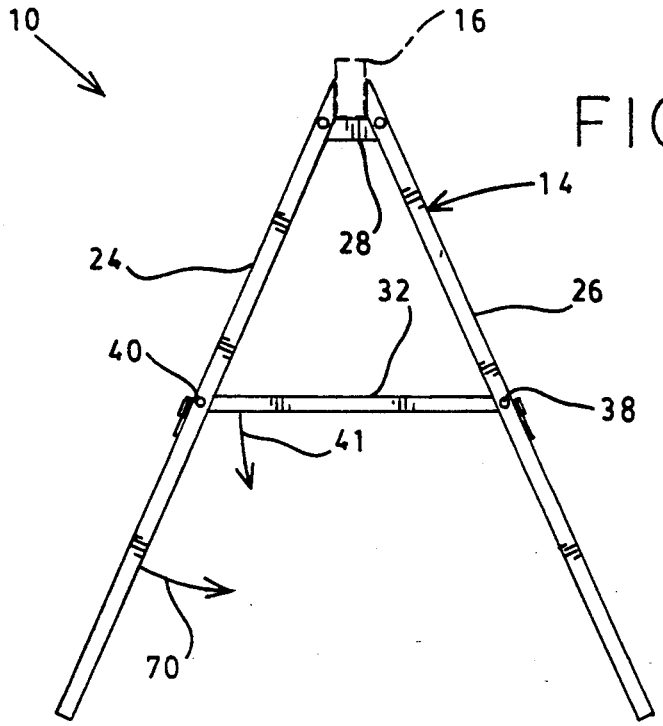
FIG. 3 is an end view, partially cut away, of the structure illustrated in FIG. 1.
Figure 7:
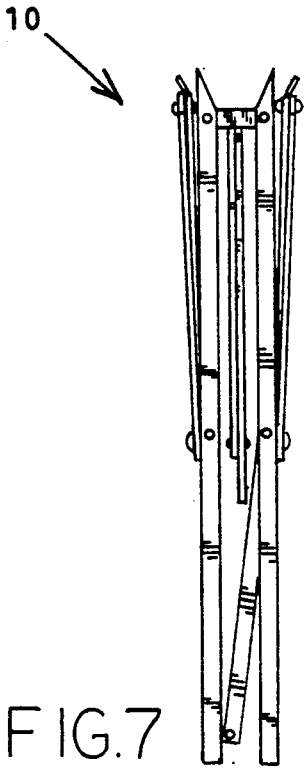
FIG. 7 is a drawing illustrating the end view of the unit of FIG. 1 when folded.

FIG. 3 is an end view of the saw horse 10 embodiment of FIG. 1. As explained above, when pin 40 is removed, transverse brace 32 can pivoted downwardly around pivot member 38 as indicated by the arrow 41. When this brace 32 is fully pivoted, the leg 24 can be pivoted toward leg 26 as indicated by the arrow 70. When fully collapsed, the unit appears as shown in FIG. 7.

A more detailed illustration of longitudinal brace 54 is shown in FIGS. 4 and 5. Here the designation "A" behind numerals depicting parts indicates that it is the same as the corresponding part of longitudinal brace 52 shown in FIGS. 1 and 2. A portion of an end of brace portion 58A is removed, as at 72, so that an overlapping projection 74 of brace portion 56A, which is curved as shown, can rest against a stop surface 76. In this position, the brace portions 56A and 58A are prevented from any farther downward movement.

Figure 6:
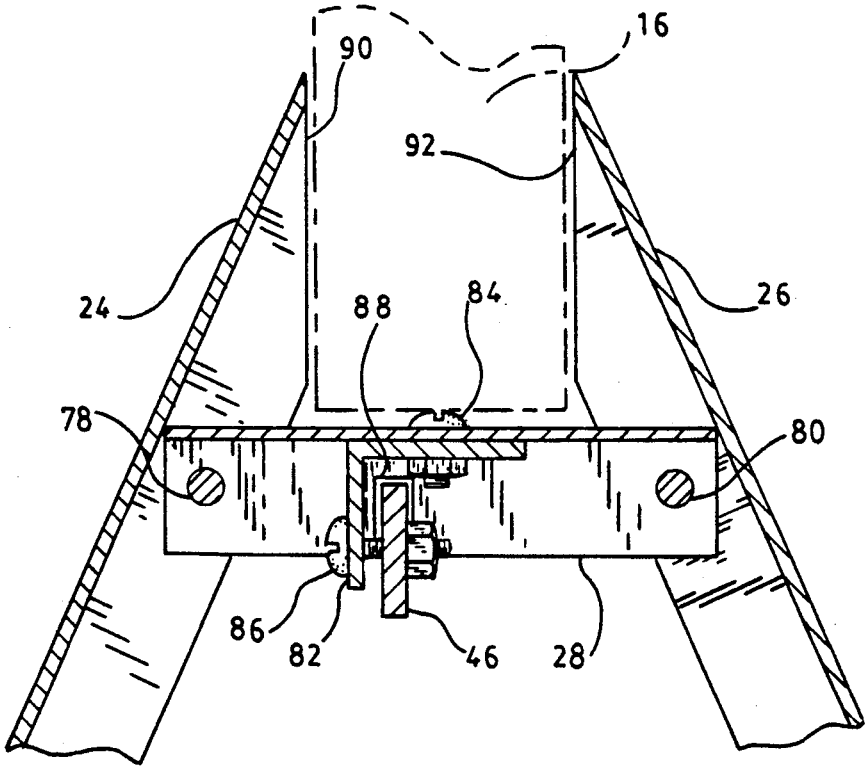
FIG. 6 is a cross-sectional drawing, partially cut away, taken at 6—6 of FIG. 1 illustrating the pivotal mounting of the upper longitudinal brace of the sawhorse of FIG. 1.

The pivotal mounting of longitudinal brace 42 is shown in FIG. 6 which is a cross-sectional drawing taken at 6—6 of FIG. 1. The bracket 28 is securely attached to leg 24 as with a rivet 78, and pivotally attached to leg 26 with a pivot pin so. Substantially midway of the bracket 28 is a transverse angle member 82, or an equivalent mounting member, that is attached as with a rivet or bolt 84. The aforementioned portion 46 of the upper longitudinal brace 42 is pivotally joined to this angle member with a bolt 86 or equivalent. The attachment at this point is relatively loose so as to permit the brace portion 46 to move during the folding operation of the saw horse 10. The bracket 28 is provided with a notch 88 to accept the brace portion 46 when it is in the extended position. This drawing further illustrates the clamping of the crosspiece 16 between the faces 90, 92 of the legs 24, 26 respectively.

A different embodiment of the transverse brace 32 is shown at 94 in FIGS. 9 and 10. In this embodiment, brace 94 has two portions 96, 98 with oppositely disposed ends pivotally attached to legs 24, 26, respectively, with pivot members 100 and 102. Further, the portions 96, 98 are pivotally connected at adjoining ends with a pivot member 104. In the particular embodiment shown, one portion 98 is provided with a slot 106 to permit sliding movement of pivot member 104 during the folding and unfolding operations indicated by the arrows 108, 110. However, it will be understood that similar folding would take place without this slot 106. In these embodiments, an extension 112 of the brace portion 98 provides means for applying pressure to assure full extension of brace 94.

Figure 8:
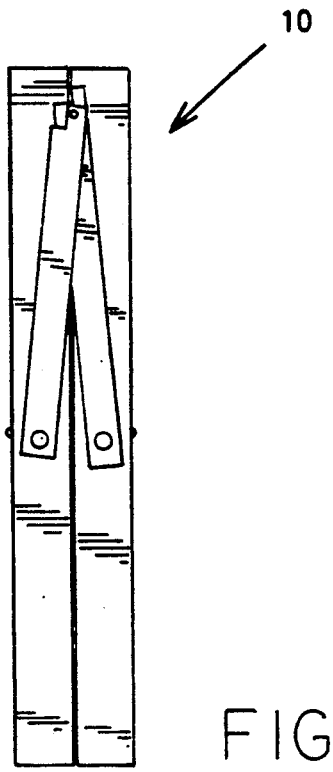
FIG. 8 is a drawing illustrating the front view of the unit of FIG. 1 when folded.

In a normal utilization of the present invention, the sawhorse 10 is transported to a use site in a folded condition as illustrated in FIGS. 7 and 8. A user may wish to have the saw horse inserted into a suitable container, or at least bound with a strap, (neither shown) to facilitate handling without partial unfolding. When the sawhorse is to be used, the end supports 12, 14 are separated from each other by extending the three longitudinal braces 42, 52 and 54 to their full extension as illustrated in FIGS. 1 and 2. If desired, the pin 50 can be inserted into the brace 42 for stability. Then, with the crosspiece 16 in position, legs of each of the end supports 12, 14 are spread and locked in place with the transverse braces 30 and 32 (or braces like 94). With the braces 30, 32, optionally the pins 36 and 40 can be inserted to assure full separation of the respective legs of the end supports 12, 14. In this position, the crosspiece 16 (typically a piece of 2×4 in. or 2×6 in. lumber) is fully grasped. Then, if the crosspiece needs to be replaced, the transverse braces 30, 32 can be released pending the insertion of the new crosspiece.

As stated above, the legs 18, 20, 24 and 26, as well as the brackets 22, 28 and transverse braces 30, 32, are fabricated from channel stock. Typically, this stock is the same as utilized for ladder construction. Thus, no special stock is needed for the present invention, and the sawhorse can be fabricated from "scraps" of the ladder fabrication process. The longitudinal braces 42, 52 and 54 are typically fabricated from flat stock, again often utilized in ladder construction. Accordingly, the present invention can be economically fabricated.

From the foregoing it will be understood by persons skilled in the art that an improved collapsible sawhorse construction has been provided. This sawhorse construction has all elements required for the two support ends and interconnecting braces. All that needs to be added at a use site is a crosspiece, such as a scrap of lumber, to complete the sawhorse and initiate use of the same. The unit is sturdy, and can be compressed, upon folding of the braces and legs, into a compact unit for portability. It provides a stable support for performing work, and is constructed from standard stock material to reduce costs of fabrication.

It will be understood that specific embodiments and dimensions have been described. However, these descriptions are not for limiting the invention. Rather, the invention is to be limited only by the appended claims and their equivalents.

I claim:

1. A collapsible sawhorse unit for receiving a replaceable crosspiece, said sawhorse unit comprising:

a first A-shaped end support having a pair of leg members, said leg members pivotally joined proximate a first end with a transverse bracket having one end attached to one leg and pivotally joined to a second leg, said first end of said leg members for grasping a replaceable crosspiece, said first end support provided with a pivotal transverse brace intermediate said first end of said leg members and an opposite end of said leg members;

a second A-shaped end support having a pair of leg members, said leg members pivotally joined proximate a first end with a second transverse bracket having one end attached to one leg and pivotally joined to a second leg, said first end of said leg members for grasping the replaceable crosspiece, said second end support provided with a pivotal transverse brace intermediate said first end of said leg members and an opposite end of said leg members;

a first folding longitudinal brace having opposite ends and a midpoint, one of said opposite ends pivotally joined to said transverse bracket of said first end support and a second of said opposite ends pivotally joined to said second transverse bracket of said second end support, said first folding longitudinal brace member provided with a pivot element at said midpoint, adjoining ends of said first folding longitudinal brace provided with aligned holes near said midpoint to receive a removable pin member, said pin member providing stiffening of said first folding longitudinal brace by preventing pivoting at said pivot member thereof; and a pair of further folding longitudinal braces positioned on opposite sides of said sawhorse unit, each having opposite ends and a midpoint, one of said opposite ends pivotally attached to a leg of said first end support and a second of said opposite ends pivotally attached to a leg of said second end support, each said further folding longitudinal braces provided with a pivot element at said midpoint.

2. The saw sawhorse of claim 1 wherein adjoining ends of each of said further folding longitudinal braces have mating shoulder surfaces to permit pivotal movement in a direction only toward said first folding longitudinal brace.

3. The sawhorse unit of claim 1 wherein said transverse brace of each of said first and second end supports comprises:

a rigid member having opposite ends;

a pivot member joining one of said opposite ends to a leg of said end support; and a removable pivot member joining another of said opposite ends to a second leg of said end support;

whereby when said removable pivot member is removed, said rigid member is pivotal against said leg when said legs are moved toward each other, and when said removable pivot member is inserted, said rigid member strengthens said end support.

4. The sawhorse unit of claim 1 wherein said transverse brace of each of said first and second end supports comprises:

a folding member having opposite ends and a midpoint;

a pivot member joining one of said opposite ends to a leg of said end support;

a second pivot member joining another of said opposite ends to a second leg of said end support; and a third pivot member joining adjoining ends of portions of said folding member at said midpoint whereby said portions of said folding member pivot toward each other when legs of said end support are folded toward each other.

5. The sawhorse member of claim 4 wherein one of said portions of said folding member is provided with a slot proximate said midpoint to receive said third pivot member.

6. The sawhorse member of claim 1 wherein said legs of said first and second end supports are fabricated from channel stock of one size, said transverse braces are fabricated from channel stock of a size to be received within said legs, and said first and folding longitudinal braces are fabricated from flat stock.

7. A collapsible sawhorse unit for receiving a replaceable crosspiece, said sawhorse unit comprising:

a first A-shaped end support having a pair of leg members, a transverse bracket joining said leg members proximate a first end with one end of said transverse bracket fastened to one leg and a second end pivotally joined to a second leg, said first end of said legs for grasping a replaceable crosspiece therebetween, said first end support provided with a pivotal transverse brace intermediate said first end of said leg members and an opposite end of said leg members;

a second A-shaped end support having a pair of leg members, a transverse bracket joining said leg members proximate a first end with one of said transverse bracket fastened to one leg and a second end pivotally joined to a second leg, said first end for grasping the replaceable crosspiece therebetween, said second end support provided with a pivotal transverse brace intermediate said first end of said leg members and an opposite end of said leg members;

a first folding longitudinal brace having opposite ends and a midpoint, one of said opposite ends pivotally joined to said transverse bracket of said first end support and a second of said opposite ends pivotally joined to said transverse bracket of said second end support proximate said first end of said leg members, said first folding longitudinal brace member provided with a pivot element at said midpoint and with aligned holes in adjoining ends of portions near said pivot element;

a removable pin member for being inserted into said aligned holes when said portions of said first folding longitudinal brace are axially aligned; and a pair of further folding longitudinal braces positioned on opposite sides of said saw horse unit, each having opposite ends and a midpoint, one of said opposite ends pivotally attached to a leg of said first end support and a second of said opposite ends pivotally attached to a leg of said second end support, each said further folding longitudinal braces provided with a pivot element at said midpoint and with mating shoulder surfaces on adjacent ends of portions of said further folding longitudinal braces to limit pivotal motion of said further folding longitudinal braces to a direction only toward said first longitudinal folding brace.

8. The sawhorse unit of claim 7 wherein said transverse brace of each of said first and second end supports comprises:

a rigid member having opposite ends;

a pivot member joining one of said opposite ends to a leg of said end support; and a removable pivot member joining another of said opposite ends to a second leg of said end support;

whereby when said removable pivot member is removed, said rigid member is pivotal against said leg when said legs are moved toward each other, and when said removable pivot member is inserted, said rigid member strengthens said end support.

9. The sawhorse of claim 7 wherein said transverse brace of each of said first and second end supports comprises:

a folding member having opposite ends and a midpoint;

a pivot member joining one of said opposite ends to a leg of said end support;

a second pivot member joining another of said opposite ends to a second leg of said end support; and a third pivot member joining adjoining ends of portions of said folding member at said midpoint whereby said portions of said folding member pivot toward each other when legs of said end support are folded toward each other.

10. The sawhorse member of claim 9 wherein one of said portions of said folding member is provided with a slot proximate said midpoint to receive said third pivot member.

11. The saw horse member of claim 7 wherein said legs of said first and second end supports are fabricated from aluminum channel stock of one size, said transverse braces are fabricated from aluminum channel stock of a size to be received within said legs, and said first and further folding longitudinal braces are fabricated from aluminum flat stock.

* * * * *